US007270055B1

(12) United States Patent
Haberstroh et al.

(10) Patent No.: US 7,270,055 B1
(45) Date of Patent: Sep. 18, 2007

(54) CENTRIFUGAL BOOST WHEEL FOR STRAPPING MACHINE

(75) Inventors: James A. Haberstroh, Vernon Hills, IL (US); Christopher S. Krohn, New Lenox, IL (US); Allan J. Bobren, Streamwood, IL (US)

(73) Assignee: Illnois Tool Works, Inc., Glenview, IL (US)

( * ) Notice: Subject to any disclaimer, the term of this patent is extended or adjusted under 35 U.S.C. 154(b) by 0 days.

(21) Appl. No.: 11/558,673

(22) Filed: Nov. 10, 2006

(51) Int. Cl.
*B65B 13/04* (2006.01)
*B65B 13/18* (2006.01)

(52) U.S. Cl. ..... 100/26; 100/29; 53/589

(58) Field of Classification Search ..... 100/26, 100/29, 32, 33 R, 33 PB; 53/582, 589, 590; 226/25, 188–192, 194
See application file for complete search history.

(56) References Cited

U.S. PATENT DOCUMENTS 4,145,963 A * 3/1979 Leslie et al. ..... 100/4
6,976,422 B2 * 12/2005 Haberstroh et al. ..... 100/6
2004/0244606 A1 * 12/2004 Haberstroh et al. ..... 100/26

* cited by examiner

*Primary Examiner*—Jimmy Nguyen
(74) *Attorney, Agent, or Firm*—Mark W. Croll; Donald J. Breh; Levenfeld Pearlstein, LLC

(57) ABSTRACT

A refeed system for use in a strapping machine for feeding a strapping material around a load, positioning, tensioning and sealing the strapping material around the load. The refeed system refeeds strapping material into feed elements. The refeed system includes a driven, rotatable boost wheel having a first diameter when in a stationary mode and a second, larger diameter when in a second, rotating mode and an idler element opposite of the boost wheel. When the boost wheel is in the stationary mode, a first gap is defined between the boost wheel and the idler element to permit the free conveyance of strap through the gap and when the boost wheel is in the second rotating mode a strap, positioned in the gap is engaged by the boost wheel and is conveyed through the gap.

18 Claims, 4 Drawing Sheets

CENTRIFUGAL BOOST WHEEL FOR STRAPPING MACHINE

BACKGROUND OF THE INVENTION

The present invention is directed to a strapping machine refeed system. More particularly, the present invention is directed to a centrifugal boost wheel in a strapping machine refeed system to refeed strap following a strap error or fault.

Strapping machines are well known in the art for securing straps around loads. One type of known strapper is a stationary unit that includes a strapping head or weld head and drive mechanism mounted within a frame. A chute is mounted to the frame, through which the strapping material is fed. In a typical arrangement, a table-top or work surface is likewise mounted to the frame.

In a typical stationary strapper, the chute is mounted from about the work surface, and the strapping head is mounted below the work surface. Strap is fed from a source or dispenser to the strapping or weld head. The strapping head provides a number of functions. First, it provides structure to grip portions of the strap during the course of a strapping operation. The strapping head also includes a cutter to cut the strap from a strap source or supply. Last, the strapping head includes a sealer to seal an overlying course of strapping material onto itself. This seal is commonly referred to as a weld and is effected by heating overlying courses of the strap by use of a vibrating element or a heated element.

The feed system includes a pair of feed and tensioning or retraction wheels to feed the strap through the strapping head and chute and back to the strapping head, to pull the strap from the chute to around the load and to tension the strap around the load. The strapping machine can also include a winder or tensioning element to "pull" a greater tension in the strap. Typically, the winder is positioned in the feed system.

To permit efficient operation of the strapping machine and the overall strapping process, the strapping machine can be fully automated or substantially fully automated.

In the event a strap error occurs, the faulted strap is ejected from the feed system. In order reduce required operator attention, an automatic refeed is used to refeed the strap to the strapping head (to the feed wheels). Known automatic refeed systems include complex arrangement having a pair of rotating elements, one of which pivots toward and away from the other depending upon the presence or absence of strap between the elements. While these known systems function well, in order to maintain the systems optimally functioning, significant set-up and maintenance is required. In addition, when the strapping machine is operating in a mode in which high tension is required, the strap is pulled around the re-feed element, thus necessitating a relatively complex strap path arrangement.

Accordingly, there is a need for a strapping machine having a strap feeding and tensioning system with automatic refeed of the strap material. Desirably, such a system automatically refeeds the strap into the strapping head using elements that can remain present in the strap path during normal strapping operation.

BRIEF SUMMARY OF THE INVENTION

A refeed system is for use in a strapping machine of the type for feeding a strapping material around a load, positioning, tensioning and sealing the strapping material around the load. The refeed system automatically refeeds the strap into the strapping head using elements that remain present in the strap path during normal strapping operation.

The feed system includes a pair of feed elements for feeding the strapping material into strapping machine. The refeed system is configured to refeed strapping material into the feed elements and includes circumferentially expanding means for engaging the strapping material and conveying the strapping material to the feed elements when in a first state and for permitting free movement of the strapping material when in a second state. A present circumferentially expanding means is configured as a driven, rotatable boost wheel having an axis of rotation and having a first diameter when in a stationary mode (the first state) and a second, larger diameter when in a second, rotating mode (the second state). An idler element is positioned opposite of the boost wheel. The boost wheel is mounted to a motor for driving the wheel.

When the boost wheel is in the stationary mode, a first gap is defined between the boost wheel and the idler element to permit the free conveyance of strap through the gap. When the boost wheel is in the second rotating mode a strap, positioned in the gap is engaged by the boost wheel and is conveyed through the gap. The axis of rotation of the boost wheel remains fixed when the boost wheel is in the first and second positions.

In a present system, the boost wheel has a hub having a pair of opposing shoes mounted thereto. The shoes are movable between first and second positions to define the first and second diameters. The shoes are movable from the first position to the second position by rotation of the boost wheel.

Preferably, each shoe has a first end and a pivot pin at the first end for pivoting movement between the first and second positions. The shoes can include a slotted opening at a second end for receiving the pivot pin of the other shoe. In this manner, the pivot pin resides in the slotted opening and defines a stop to stop movement of the shoe beyond the second position.

The shoes have an outer periphery that defines a circle when in the first position and substantially defines an oval shape in the second position. To readily accommodate both the pivot and stop functions at each pivot pin, the first end of each shoe is bifurcated, defining a slot between the bifurcations such that the second end of the other shoe fits within the slot. A strapping machine having the refeed system is also disclosed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

While the present invention is susceptible of embodiment in various forms, there is shown in the figures and will hereinafter be described a presently preferred embodiment with the understanding that the present disclosure is to be considered an exemplification of the invention and is not intended to limit the invention to the specific embodiment illustrated.

It should be further understood that the title of this section of the specification, namely, "Detailed Description Of The Invention", relates to a requirement of the United States Patent Office, and does not imply, nor should be inferred to limit the subject matter disclosed herein.

Figure 1:
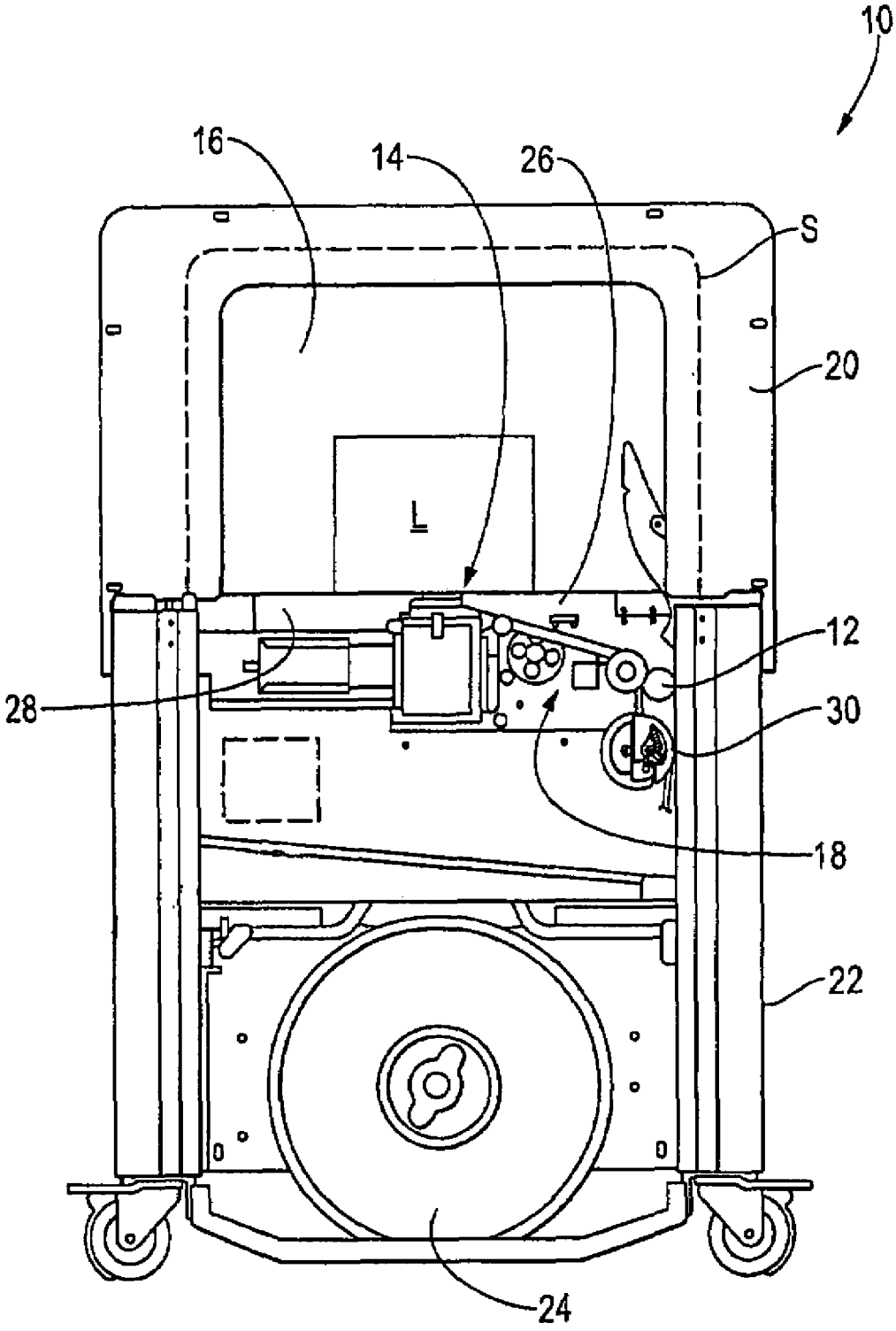
FIG. 1 is a front view of an exemplary strapping machine having a centrifugal boost wheel embodying the principles of the present invention.
Figure 2:
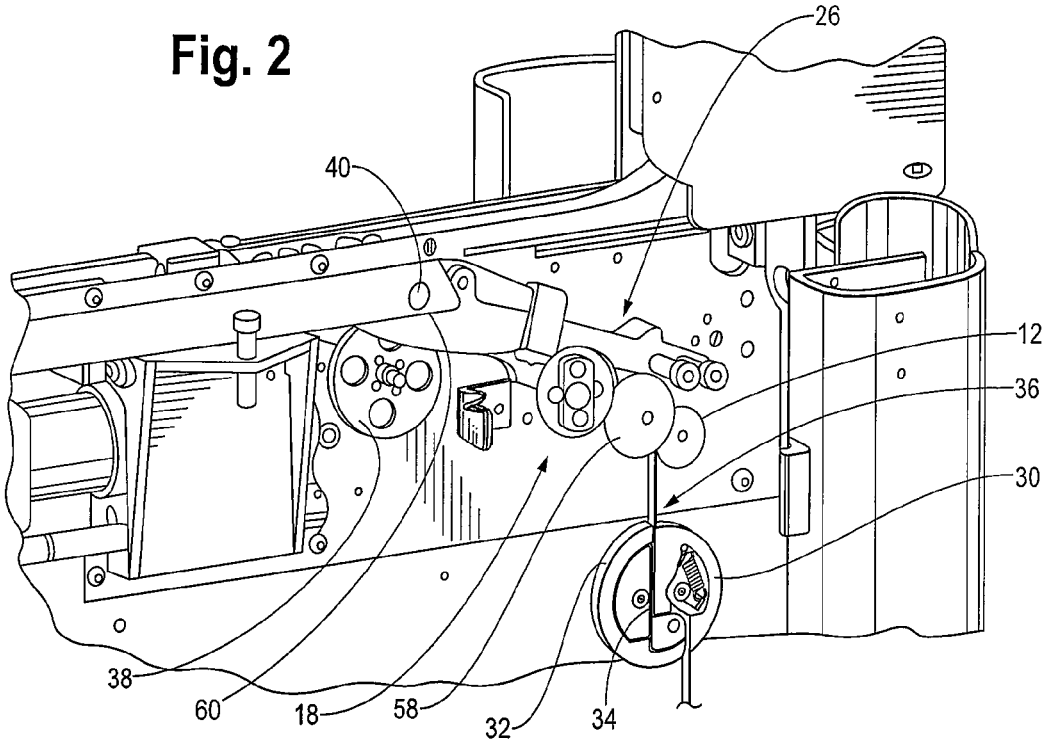
FIG. 2 is an enlarged, partial view of the feed system shown in the operating position and with a section of strap material traversing through the feed system.
Figure 3:
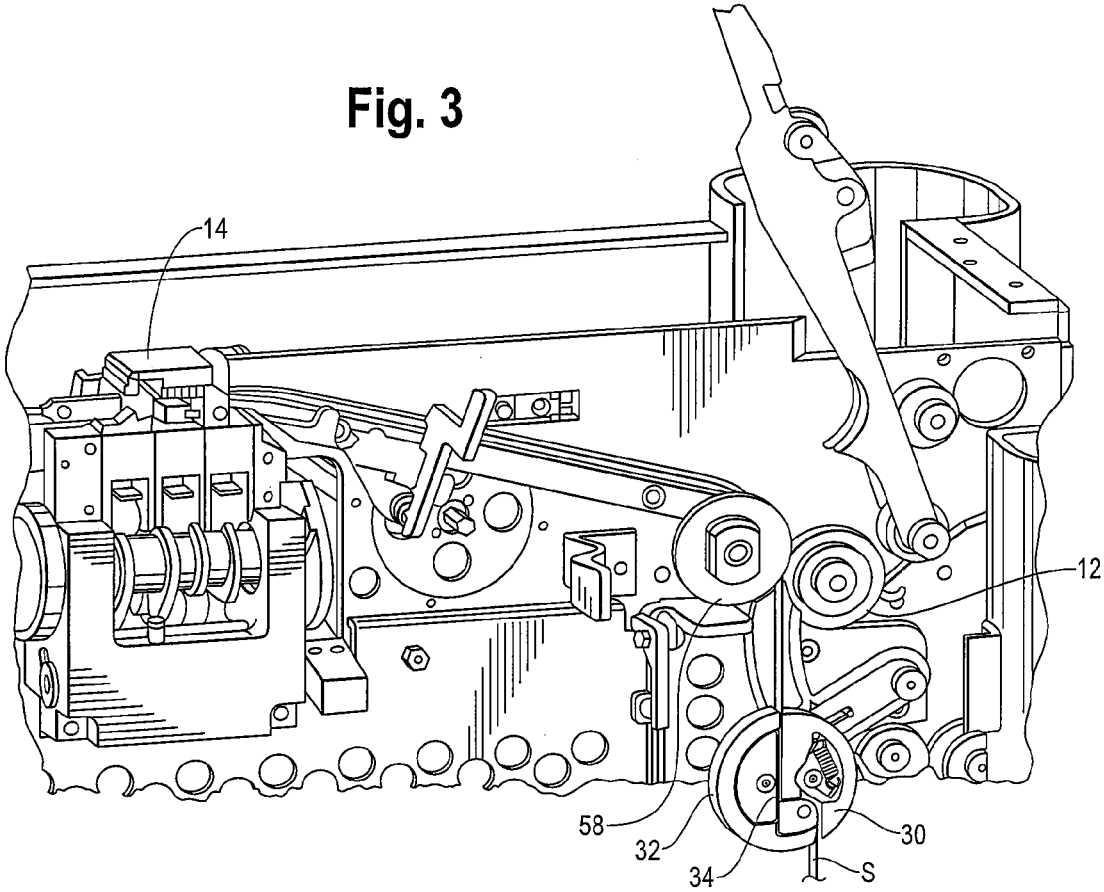
FIG. 3 is a view similar to that of FIG. 2 with the strap guide open to access the strap feed path.
Figure 4:
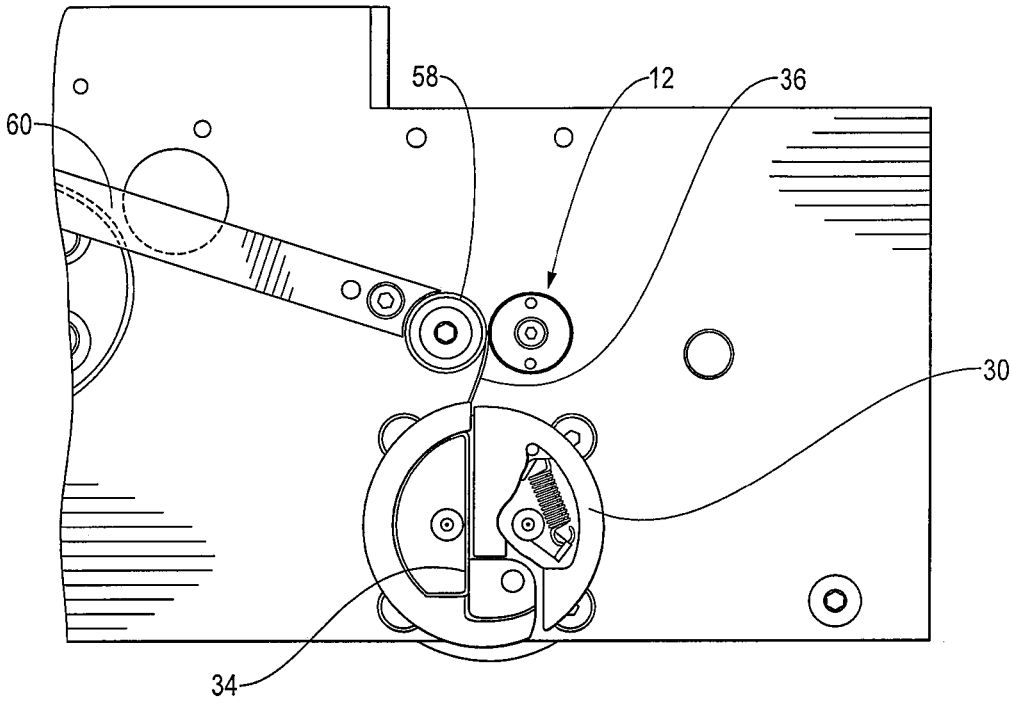
FIG. 4 is an enlarged, partial front view of the feed system showing a winder, an idler wheel and the boost wheel in the strap feed path.
Figure 5:
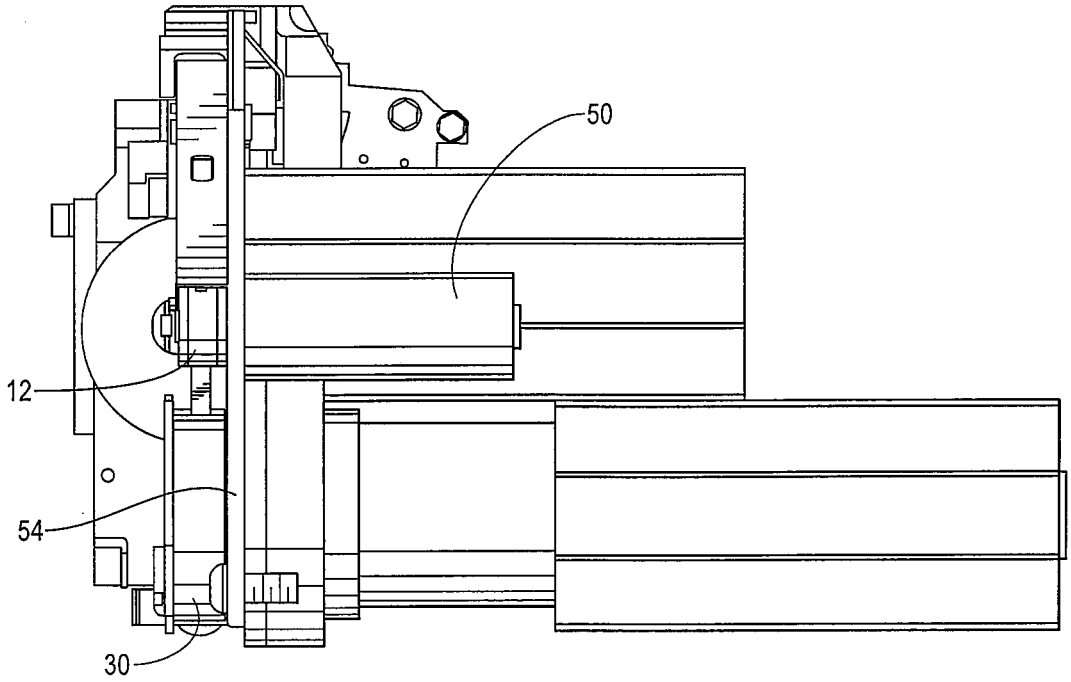
FIG. 5 is a side view illustrating the boost wheel and winder and their respective motors.
Figure 6:
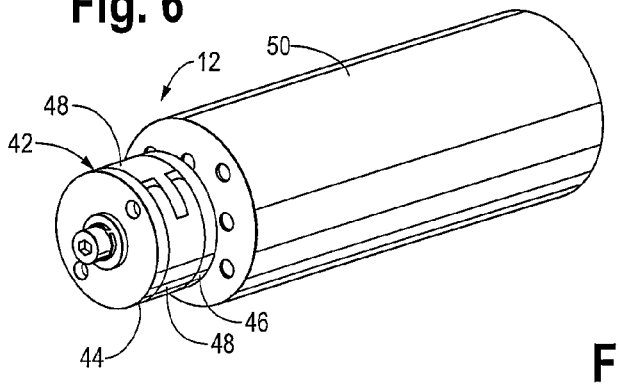
FIG. 6 is a perspective view of the boost wheel and motor.
Figure 7:
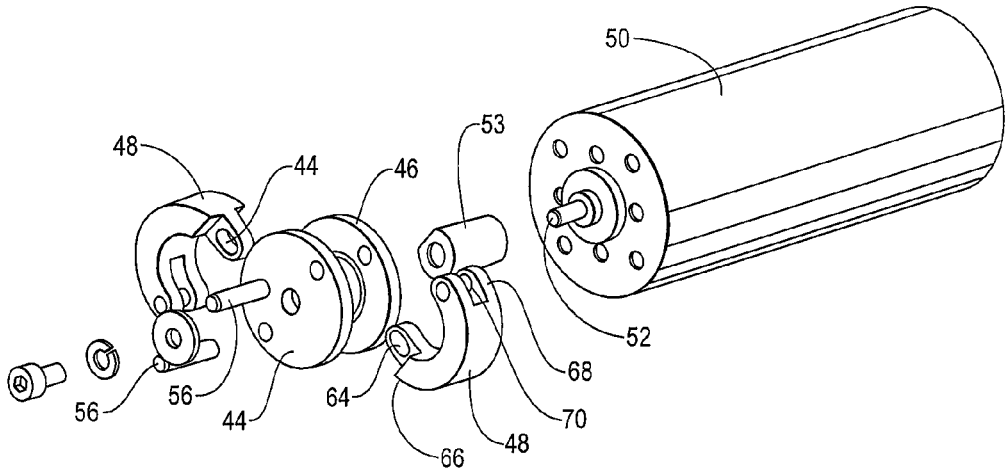
FIG. 7 is an exploded view of the boost wheel and motor.

Referring to the figures and in particular to FIG. 1 there is shown a strapping machine 10 having a centrifugal boost wheel 12 embodying the principles of the present invention. The illustrated machine 10 is a bottom-seal strapper, meaning that the strapping head (or sealing head 14), which forms the seal of the strap S onto itself is at the bottom of the area 16 into which the load L is positioned for strapping. The strapper 10 includes, generally, the strapping or sealing head 14, a feed system 18 and a strap chute 20. A frame 22 supports the various elements of the machine 10. A dispenser 24 supplies the strap material S to the strapper 10 via the feed system 18 to a feed head 26.

In a typical configuration, the strap S is fed into the strapper 10 at the feed head 26 and is directed through sealing head 14 and into the bottom leg 28 of the strap chute 20, around the chute 20 and back to the sealing head 14. Once the strap S reenters the sealing head 14, a free end of the strap S is held or secured, the feed end is tensioned around the load L, and the overlapping strap courses are sealed to one another as the feed end is severed from the supply. The load L is then discharged from the machine 10.

In the course of a cycle of machine 10 operation, as the strap S is retracted and tensioned around the load L, it is pulled from the strap chute 20. Tension is further applied by a winder 30. The winder 30 is a rotating element that has an outer or peripheral strap path 32 and a central strap channel 34. During feed and retraction cycles, the strap S traverses through the central strap channel 34 to the feed head 26. During the tensioning cycle, the winder 30 is actuated (rotated) such that the strap S winds around the peripheral path 32 of the winder 30 to draw tension in the strap S. When the strapping cycle has finished, the winder 30 "unwinds" to unwrap the strap S from the winder 30 and to align the central strap channel 32 with the strap path (indicated generally at 36). An exemplary winder 30 is illustrated and described in Bell Jr. et al., U.S. Pat. No. 6,708,606, which is commonly assigned with the present application and is incorporated herein by reference.

At times during the strapping cycle, strap jams may occur, or other types of strap misfeeds may occur that pull the strap rearward beyond the feed wheels 38, 40. In order to automatically refeed the strap S (so that operator attention is minimized or eliminated) the strap S must be refed to the feed wheels 38, 40.

The present centrifugal boost wheel 12 provides just such boost or push for the strap S during refeed without interfering with movement of the strap S through the feed system 18 during normal operations, e.g., the feed, retraction and tension cycles. The boost wheel 12 includes a hub 42 having front and rear walls 44, 46 and a pair of opposing, movable shoes 48 mounted to the hub 42. The hub 42 is mounted to a motor 50 (at the motor shaft 52), by for example, a spacer 53 or other element. In this manner, the motor 50 can be mounted to a rear side of the strapper (strapping head) support plate 54 to further increase access to the strap path 36. The motor 50 is fixedly mounted to the plate 54 and thus the rotational axis $A_{42}$ of the hub 42 is fixed.

The shoes 48 have an outer or peripheral circular profile (see FIG. 8A) and are pivotally mounted to the hub 42 at a pivot points 55, by pivot pins 56, that are spaced from the central axis $A_{42}$ of the hub 42. As the wheel 12 rotates, the centrifugal force forces (or urges) the shoes 48 outward, away from the center or central axis $A_{42}$ of the hub 42. Because the shoes 48 are mounted to pivot pins 56, the shoes 48 will pivot outwardly from the hub 42. As the shoes 48 pivot outwardly, they create a pseudo expanded diameter $d_b$ (see FIG. 8B) of the hub 42, effectively simulating a larger diameter wheel 12.

An idler wheel 58 is positioned opposite of the boost wheel 12 in the strap path 36. As such, as the shoes 48 pivot outwardly the shoes 48 pinch the strap S between the boost wheel 12 and the idler wheel 58. Sufficient friction is developed such the strap S is urged along the strap path 36 to the feed wheels 38, 40. Because the strap S is fairly free to move through the strap path 36, the amount of friction that the boost wheel 12 needs to develop to convey the strap S to the feed wheels 38, 40 (into the nip 60 between the feed wheels 38, 40) is relatively small.

Figure 8A:
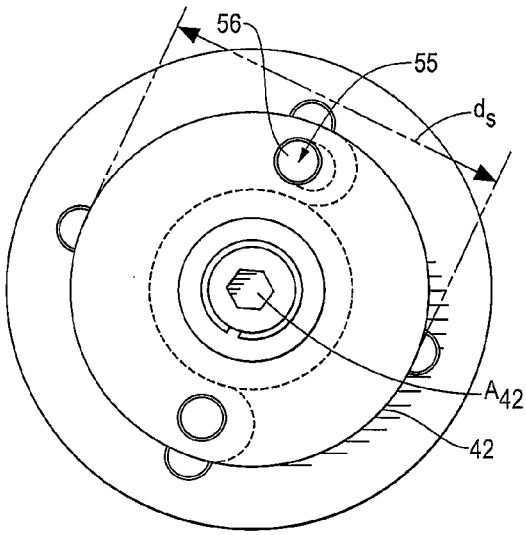
FIGS. 8A and 8B illustrate the boost wheel in the stationary or retracted condition (FIG. 8A) and the rotating or feed condition (FIG. 8B), the wheel being shown with only one of the shoes mounted to the wheel hub for ease of illustration.
Figure 8B:
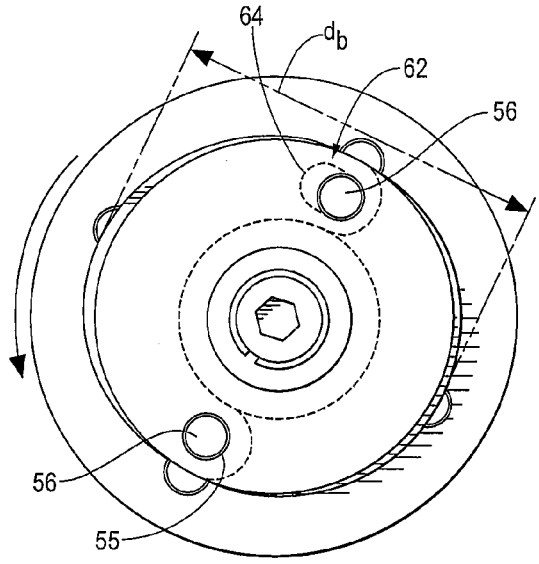

The outward distance that the shoes 48 can pivot is limited by stop means 62. In a present arrangement, the stop means 62 is provided by a notched opening 64 in an opposite end 66 of the shoe 48 (opposite of the pivot 55) that receives the other shoe's pivot pin 56. In this manner each pivot pin 56 serves as a pivot 55 for one shoe 48 and a stop 62 for the other shoe 48. This reduces the number of parts overall that are needed and simplifies the design of the wheel 12. In a present embodiment, the pivot side 55 of the shoe 48 is bifurcated (as indicated at 68) and the stop or movable side 66 of the shoe 48 fits into a slot 70 in the bifurcated end 68 of the shoe 48. FIGS. 8A and 8B show the wheel 12 with one shoe 48 (for ease of illustration) in the first position which is a stationary or non-rotating mode (FIG. 8A) and in the second position which is the rotating or boost mode (FIG. 8B), with the wheel rotating in the direction shown. The stationary diameter of the wheel 12 is indicated at d, and the boost diameter of the wheel 12 is shown at $d_b$. When in the boost position, the profile of the wheel including both of the shoes 48 pivoted outwardly, is about an oval, which effectively presents the expanded diameter $d_b$.

The present boost wheel 12 has a number of advantages over prior refeed arrangements. As will be appreciated from the figures, it is a simple design, but still provides a sufficient boost to move the strap S into the feed wheels 38, 40 (the nip 60 between the wheels) to allow the feed wheels 38, 40 to convey the strap S to the strapping head 14. In addition, the boost wheel 12 is self-actuating. That is, only rotation of the wheel 12 is required to engage the wheel 12 with the strap S. No springs or other elements are needed to move the shoes 48 outwardly (to the second position) to engage the strap S, nor to return the shoes 48 to the first position or the free strap conveyance position.

Moreover, the wheel 12 is self-regulating. That is, the movement of the shoes 48 does not have to be adjusted to accommodate strap S of differing thicknesses. Rather, the shoes 48 will pivot outwardly only so far as the thickness of the strap or the stops 62 will permit. In addition, because of the simple, self-actuating design, the wheel 12 permits greater access to the strap path 36 and does not interfere with or disrupt the flow of strap S to and from the slack box 76 during normal feed and tension operations.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A refeed system for a strapping machine of the type for feeding a strapping material around a load, positioning, tensioning and sealing the strapping material around the load, the strapping machine having a feed head having a pair of feed elements for feeding the strapping material into strapping machine, a strap chute defining a strap path through which the strapping material is passed and a sealing head to seal overlapping courses of the strapping material onto itself, the refeed system configured to refeed strapping material into the feed elements, the refeed system comprising:

a driven, rotatable boost wheel having an axis of rotation and having a first diameter when in a first stationary mode and a second diameter when in a second, rotating mode, the second diameter is larger than the first diameter, and the boost wheel having a pair of opposing non-biased pivoting elements; and an idler element opposite of the boost wheel, wherein when the boost wheel is in the stationary mode, a first gap is defined between the boost wheel and the idler element to permit a free conveyance of strap through the gap and when the boost wheel is in the second rotating mode, a strap positioned in the gap is engaged by the boost wheel and is conveyed through the gap, the axis of rotation of the boost wheel remaining fixed when the boost wheel is in the first stationary mode and the second rotating mode.

2. A refeed system for a strapping machine of the type for feeding a strapping material around a load, positioning, tensioning and sealing the strapping material around the load, the strapping machine having a feed head having a pair of feed elements for feeding the strapping material into strapping machine, a strap chute defining a strap path through which the strapping material is passed and a sealing head to seal overlapping courses of the strapping material onto itself, the refeed system configured to refeed strapping material into the feed elements, the refeed system comprising:

a driven, rotatable boost wheel having an axis of rotation and having a first diameter when in a first stationary mode and a second diameter when in a second, rotating mode, the second diameter is larger than the first diameter; and an idler element opposite of the boost wheel, wherein when the boost wheel is in the stationary mode, a first gap is defined between the boost wheel and the idler element to permit a free conveyance of strap through the gap and when the boost wheel is in the second rotating mode, a strap positioned in the gap is engaged by the boost wheel and is conveyed through the gap, the axis of rotation of the boost wheel remaining fixed when the boost wheel is in the first stationary mode and the second rotating mode;

wherein the boost wheel has a hub having a first shoe and a second shoe mounted thereto, wherein the first and the second shoes oppose each other, the shoes movable between the first stationary mode and the second rotating mode to define the first and second diameters, the shoes movable from a position in the first stationary mode to a position in the second rotating mode by rotation of the boost wheel.

3. The refeed system in accordance with claim 2 wherein the first and second shoes each have a first end and a pivot pin at the first end for pivoting movement between the first stationary mode and second rotating mode.

4. The refeed system in accordance with claim 3 wherein the first and second shoes each includes a slotted opening at a second end for receiving the pivot pin of the other shoe, the pivot pin residing in the slotted opening defining a stop to stop movement of the shoe the position in the second rotating mode.

5. The refeed system in accordance with claim 2 wherein the first and second shoes have an outer periphery defining a circle when in the first stationary mode and substantially defining an oval shape in the second rotating mode.

6. The refeed system in accordance with claim 4 wherein the first end is bifurcated, defining a slot between the bifurcation and wherein the second end of the opposing shoe fits within the slot.

7. The refeed system in accordance with claim 1, the boost wheel mounted to a motor for driving the boost wheel.

8. A strapping machine of the type for feeding a strapping material around a load, positioning, tensioning and sealing the strapping material around the load, comprising:

a frame;

a strap chute;

a feed system including a pair of feed wheels for feeding the strapping material into the strap chute; and a sealing head for receiving the strapping material, sealing the strapping material to itself in overlaying courses and severing the strapping material from a supply, wherein the feed system includes a refeed system having a driven, rotatable boost wheel, the boost wheel having a pair of opposing non-biased pivoting elements, the boost wheel having a first diameter when in a first stationary mode and a second diameter when in a second, rotating mode, the second diameter is larger than the first diameter, and the feed system further includes an idler element opposite the boost wheel, and wherein when the boost wheel is in the stationary mode, a first gap is defined between the boost wheel and the idler element to permit a free conveyance of strap through the gap and when the boost wheel is in the second rotating mode, a strap positioned in the gap is engaged by the boost wheel and is conveyed through the gap.

9. A strapping machine of the type for feeding a strapping material around a load, positioning tensioning and sealing the strapping material around the load, comprising:

a frame;

a strap chute;

a feed system including a pair of feed wheels for feeding the strapping material into the strap chute; and a sealing head for receiving the strapping material, sealing the strapping material to itself in overlaying courses and severing the strapping material from a supply, wherein the feed system includes a refeed system having a driven, rotatable boost wheel having a first diameter when in a first stationary mode and a second diameter when in a second, rotating mode, the second diameter is larger than the first diameter, and the feed system further includes an idler element opposite the boost wheel, and wherein when the boost wheel is in the stationary mode, a first gap is defined between the boost wheel and the idler element to permit a free conveyance of strap through the gap and when the boost wheel is in the second rotating mode, a strap positioned in the gap is engaged by the boost wheel and is conveyed through the gap;

wherein the boost wheel has a hub having a first shoe and a second shoe mounted thereto, the shoes opposing each other, the shoes movable between the first stationary mode and the second rotating mode to define the first and second diameters, the shoes movable from a position in the first stationary mode to a position in the second rotating mode by rotation of the boost wheel.

10. The strapping machine in accordance with claim 9 wherein the first and second shoes each have a first end and a pivot pin at the first end for pivoting movement between the first stationary mode and second rotating mode.

11. The strapping machine in accordance with claim 10 wherein the first and second shoes each includes a slotted opening at a second end for receiving the pivot pin of the opposing shoe, the pivot pin residing in the slotted opening defining a stop to stop movement of the shoe beyond the second position in the second rotating mode.

12. The strapping machine in accordance with claim 9 wherein the shoes have an outer periphery defining a circle when in the first position and substantially defining an oval shape in the second position.

13. The strapping machine in accordance with claim 11 wherein the first end is bifurcated, defining a slot between the bifurcation and wherein the second end of the opposing shoe fits within the slot.

14. The strapping machine in accordance with claim 8 wherein the boost wheel is mounted to a motor for driving the boost wheel.

15. A refeed system for a strapping machine of the type for feeding a strapping material around a load, positioning, tensioning and sealing the strapping material around the load, the strapping machine having a feed head having a pair of feed elements for feeding the strapping material into strapping machine, a strap chute defining a strap path through which the strapping material is passed and a sealing head to seal overlapping courses of the strapping material onto itself, the refeed system configured to refeed strapping material into the feed elements, comprising:

circumferentially expanding means for engaging the strapping material and conveying the strapping material to the feed elements when in a first state and for permitting free movement of the strapping material when in a second state, a diameter of the circumferentially expanding means in the first state is larger than a diameter of the circumferentially expanding means in the second state, and the circumferentially expanding means having a pair of opposing non-biased pivoting elements; and an idler element opposite of the circumferentially expanding means and defining a portion of the strap path therebetween.

16. The refeed system in accordance with claim 15 wherein the circumferentially expanding means is centrifugally actuated.

17. The refeed system in accordance with claim 16 wherein the circumferentially expanding means frictionally engages the strapping material to convey the strapping material to the strap chute.

18. The refeed system in accordance with claim 15 wherein the circumferentially expanding means is mounted to motor for driving the circumferentially expanding means.

* * * * *

UNITED STATES PATENT AND TRADEMARK OFFICE

CERTIFICATE OF CORRECTION

PATENT NO. : 7,270,055 B1
APPLICATION NO. : 11/558673
DATED : September 18, 2007
INVENTOR(S) : Haberstroh et al.

It is certified that error appears in the above-identified patent and that said Letters Patent is hereby corrected as shown below:

Claim 4, Line 5 should read:

--stop movement of the shoe beyond the position in the second--

Signed and Sealed this

Fourth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,270,055 B1
APPLICATION NO. : 11/558673
DATED : September 18, 2007
INVENTOR(S) : Haberstroh et al.

It is certified that error appears in the above-identified patent and that said Letters Patent is hereby corrected as shown below:

Column 6, line 35 should read:

--stop movement of the shoe beyond the position in the second--

This certificate supersedes Certificate of Correction issued December 4, 2007.

Signed and Sealed this

Twenty-fifth Day of December, 2007

JON W. DUDAS
*Director of the United States Patent and Trademark Office*